US009669530B2

(12) United States Patent
Chen et al.

(10) Patent No.: US 9,669,530 B2
(45) Date of Patent: Jun. 6, 2017

(54) STAPLE GUN AUTOMATICALLY APPLICABLE TO STAPLES OF MULTIPLE SORTS

(71) Applicant: SAME YONG INDUSTRIAL CO., LTD., Taichung (TW)

(72) Inventors: Kuan-Chih Chen, Taichung (TW); Cheng-Lung Tu, Taichung (TW)

(73) Assignee: Same Yong Industrial Co., Ltd., Taichung (TW)

( * ) Notice: Subject to any disclaimer, the term of this patent is extended or adjusted under 35 U.S.C. 154(b) by 821 days.

(21) Appl. No.: 14/092,629

(22) Filed: Nov. 27, 2013

(65) Prior Publication Data

US 2015/0048138 A1 Feb. 19, 2015

(30) Foreign Application Priority Data

Aug. 16, 2013 (TW) ..... 102129547 A

(51) Int. Cl.
*B25C 5/06* (2006.01)
*B25C 5/11* (2006.01)
*B25C 5/16* (2006.01)

(52) U.S. Cl.
CPC ..... *B25C 5/1651* (2013.01); *B25C 5/06* (2013.01); *B25C 5/11* (2013.01); *B25C 5/1606* (2013.01); *B25C 5/1658* (2013.01)

(58) Field of Classification Search
CPC ..... B25C 5/1644; B25C 5/1637; B25C 5/16; B25C 5/1658; B25C 5/1606; B25C 5/11; B25C 5/06; B25C 5/1651
See application file for complete search history.

(56) References Cited

U.S. PATENT DOCUMENTS 5,337,945 A * 8/1994 Fehrle ..... B25C 5/1651 227/109
5,794,832 A * 8/1998 Chen ..... B25C 5/1644 227/109
6,871,768 B2 * 3/2005 Adams ..... B27F 7/19 227/109
6,974,067 B2 * 12/2005 Chen ..... B25C 1/005 227/109
2005/0121488 A1 * 6/2005 Sun ..... B25C 5/1651 227/109

(Continued)

*Primary Examiner* — Andrew M Tecco
*Assistant Examiner* — Praachi M Pathak
(74) *Attorney, Agent, or Firm* — Muncy, Geissler, Olds & Lowe, P.C.

(57) ABSTRACT

A staple gun includes: a casing having a front blocking surface; a magazine disposed in the casing; and a staple delivery element and a resilient element disposed at the magazine. The magazine includes at least a staple cutting portion each having a top surface, a front end surface, and a guiding surface connected between the top surface and the front end surface. The front end surface and the guiding surface face the front blocking surface. A clearance for passing staples is disposed between the front end surface and the front blocking surface. The staple delivery element pushes staples in the magazine in a staple delivering direction. The resilient element enables staples to push the front end surface and the guiding surface of the staple cutting portion of the magazine, such that the magazine moves relative to the casing in a clearance adjustment direction opposite to the staple delivering direction.

4 Claims, 20 Drawing Sheets

(56) References Cited

U.S. PATENT DOCUMENTS

| | | | | |
|---|---|---|---|---|
| 2006/0231582 | A1* | 10/2006 | Hong | B25C 5/1651 227/109 |
| 2008/0067089 | A1* | 3/2008 | Zhu | B25C 5/1651 206/340 |
| 2008/0296340 | A1* | 12/2008 | Wang | B25C 5/1651 227/109 |
| 2010/0230463 | A1* | 9/2010 | Yang | B25C 1/005 227/109 |
| 2012/0111916 | A1* | 5/2012 | Chen | B25C 5/0257 227/110 |
| 2013/0221056 | A1* | 8/2013 | Chen | B25C 5/162 227/120 |
| 2015/0048138 | A1* | 2/2015 | Chen | B25C 5/06 227/109 |
| 2015/0352703 | A1* | 12/2015 | Wu | B25C 5/06 227/109 |

* cited by examiner

STAPLE GUN AUTOMATICALLY APPLICABLE TO STAPLES OF MULTIPLE SORTS

BACKGROUND OF THE INVENTION

1. Technical Field

The present invention relates to staple guns, and more particularly, to a staple gun automatically applicable to staples of multiple sorts.

2. Description of Related Art

Plenty of conventional staple guns applicable to staples of different shapes are commercially available. Each of them essentially comprises a magazine, a staple delivery element, a staple striking element, and an arm. The magazine holds T-shaped staples, linearly-shaped staples, U-shaped staples, n-shaped staples, and the like. The staple delivery element delivers the staples to a ready-to-eject position below the staple striking element. A users uses the arm to drive the staple striking element to strike the staple at the ready-to-eject position such that the staple is ejected downward.

To switch to staples of a different thickness, the user has to tune a controlling element of a conventional staple gun in order to eject the staples one by one rather than two by two from the ready-to-eject position or preclude the situation where the strike performed by the staple striking element on a staple is undesirably restricted to the front half of the staple and thus fails to eject the staple.

However, after loading a conventional staple gun with staples, a user often forgets to tune the controlling element, thereby ending up with the two aforesaid glitches. Furthermore, the controlling element is capable of being tuned in a maximum two or three stages; as a result, the staple gun is usually applicable to staples of a maximum two or three thicknesses. Therefore, there is still room for improvement of conventional staple guns in terms of applicability.

BRIEF SUMMARY OF THE INVENTION

In view of the aforesaid drawbacks of the prior art, it is an objective of the present invention to provide a staple gun which is automatically applicable to staples of multiple specifications and thicknesses without being tuned by a user and thus manifests ease of use.

Another objective of the present invention is to provide a staple gun which is applicable to staples of multiple specifications and variable thickness and thus has wide application.

In order to achieve the above and other objectives, the present invention provides a staple gun automatically applicable to staples of multiple sorts, comprising: a casing having a front blocking surface; a magazine disposed in the casing and adapted to hold a plurality of staples; and a staple delivery element and a resilient element disposed at the magazine. The magazine comprises at least a staple cutting portion. The staple cutting portion has a top surface, a front end surface, and a guiding surface connected between the top surface and the front end surface. The front end surface and the guiding surface of the staple cutting portion face the front blocking surface of the casing. A clearance for passing the staples is disposed between the front end surface of the staple cutting portion and the front blocking surface of the casing. The staple delivery element pushes the staples in the magazine in a staple delivering direction, such that one of the staples abuts against the front blocking surface of the casing. The resilient element enables the staples to push the front end surface and the guiding surface of the staple cutting portion of the magazine, such that the magazine moves relative to the casing in a clearance adjustment direction opposite to the staple delivering direction.

As regards the staple gun of the present invention, the breadth of the clearance is designed to allow staples of the least thickness (in comparison with the thicknesses of staples in wide use) to squeeze through the clearance. The staple gun of the present invention is also applicable to staples which have large thicknesses and a head portion (such as T-shaped staples, U-shaped staples, and n-shaped staples) because, as soon as the foremost staple is struck, not only does the head portion of the staple slide across the guiding surface of the staple cutting portion of the magazine to reach the front end surface, but the staple cutting portion also advances in the clearance adjustment direction, such that the breadth of the clearance is automatically adjusted in accordance with the thickness of the staple to thereby allow the staple to squeeze through the clearance. Hence, the staple gun of the present invention is automatically applicable to staples of multiple thicknesses without being tuned by a user. Furthermore, the staple gun of the present invention will work, provided that the thickness of the staples is less than the least distance between the top surface of the staple cutting portion and the front blocking surface of the casing. Accordingly, the staple gun of the present invention has wide application.

The structure, features, assembly, and operation of the staple gun automatically applicable to staples of multiple sorts according to the present invention are illustrated with embodiments described in detail below. However, persons skilled in the art understand that the detailed description and embodiments of the present invention are illustrative of the present invention rather than restrictive of the claims of the present invention.

DETAILED DESCRIPTION OF THE INVENTION

Figure 1:
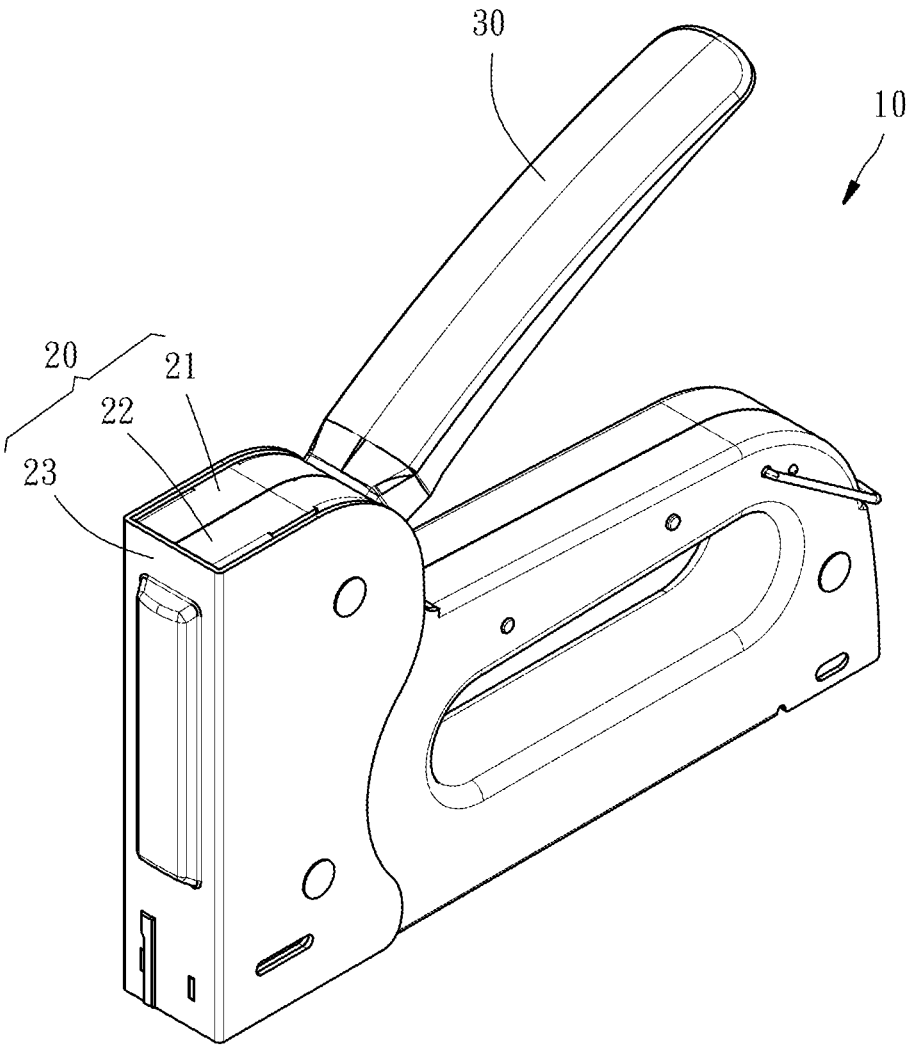
FIG. 1 and FIG. 2 are assembled perspective views of a staple gun automatically applicable to staples of multiple sorts according to a first preferred embodiment of the present invention, wherein the staple gun is viewed from two different angles, respectively.

In the embodiments below and the accompanying drawings, identical or similar components and structural features thereof are denoted with identical reference numerals.

Figure 2:
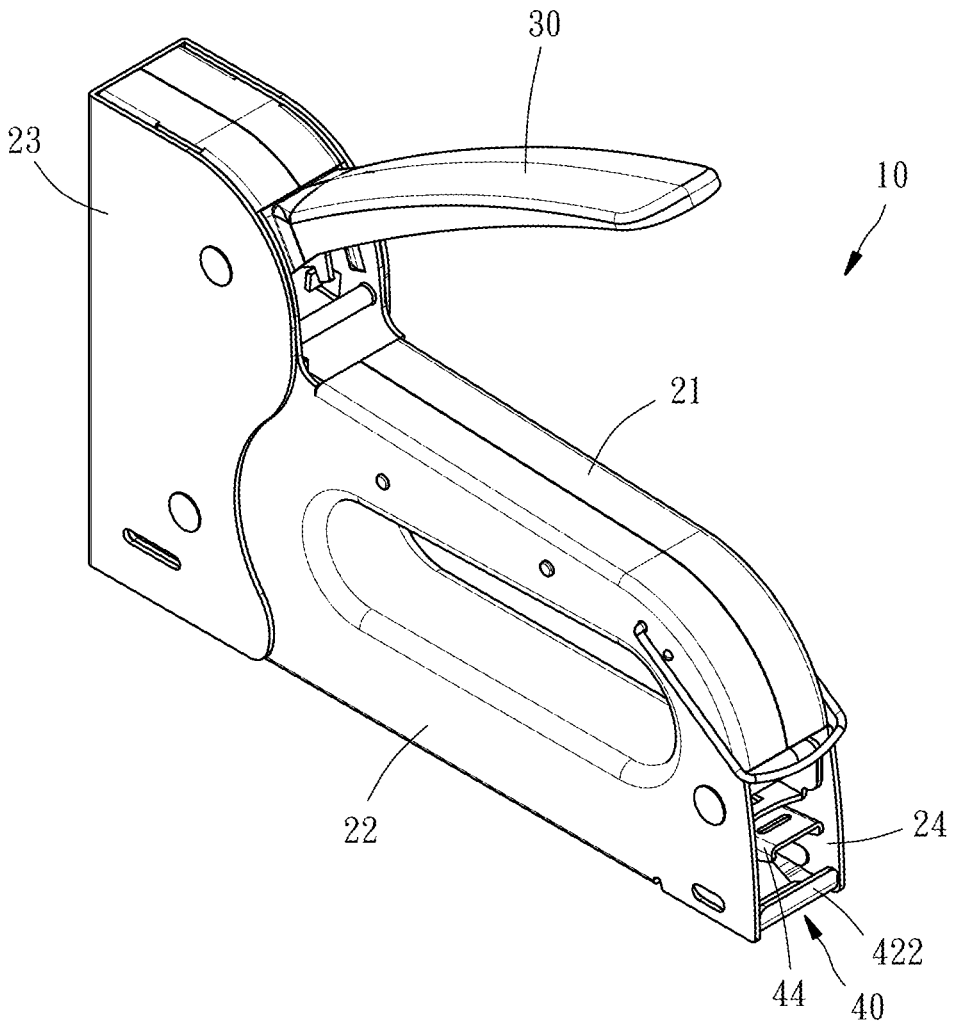
Figure 3:
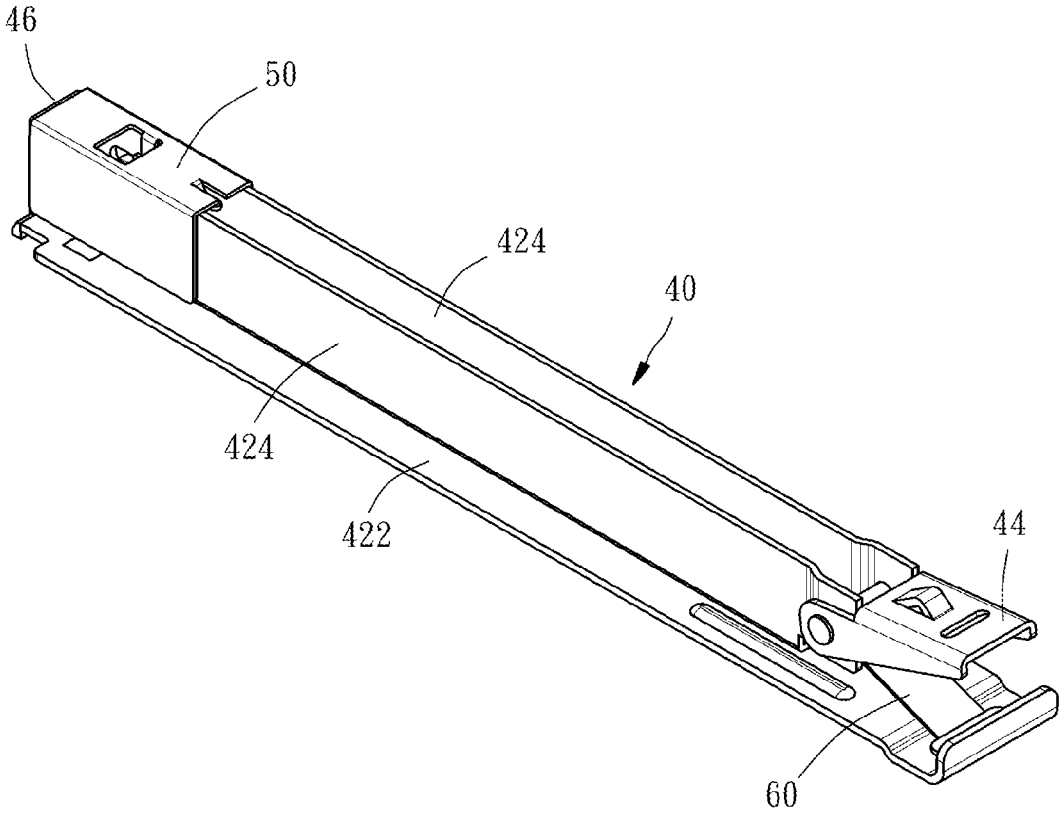
FIG. 3 and FIG. 4 are assembled perspective views of a magazine, a staple delivery element, and a resilient element of the staple gun automatically applicable to staples of multiple sorts according to the first preferred embodiment of the present invention, wherein the magazine, the staple delivery element, and the resilient element are viewed from two different angles, respectively.
Figure 4:
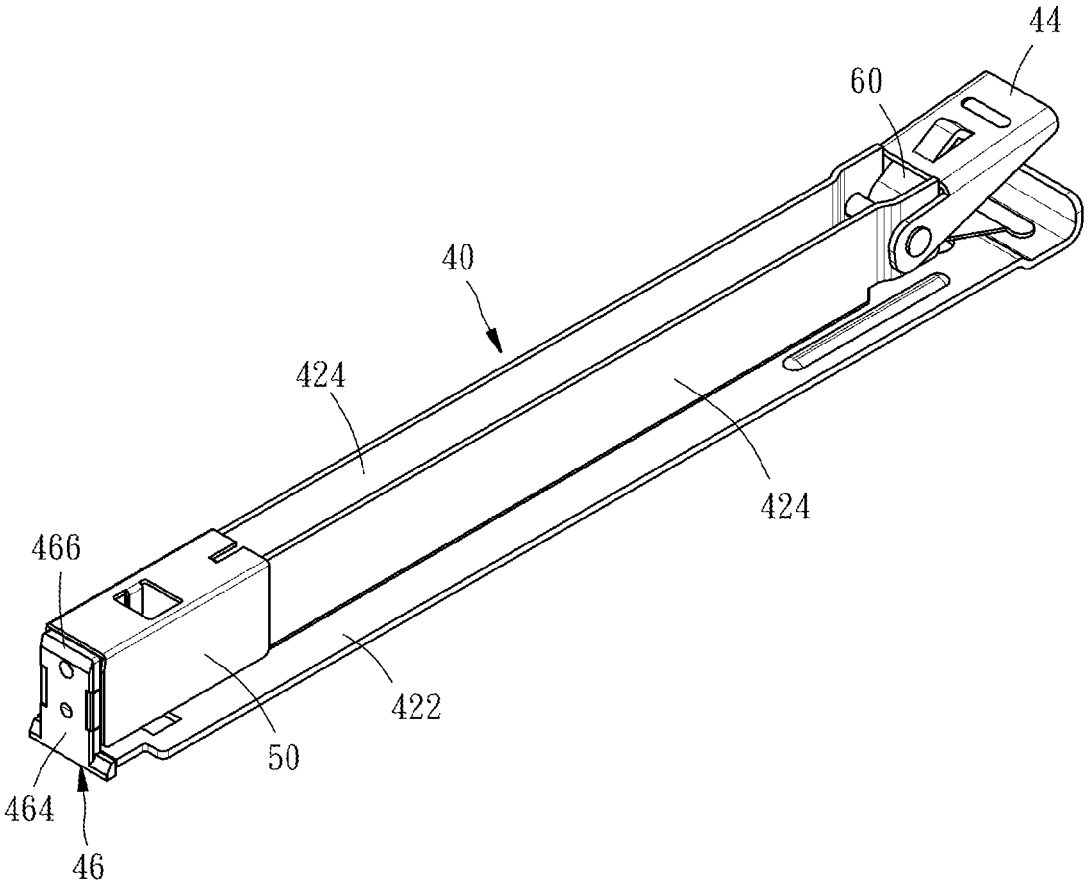
Figure 5:
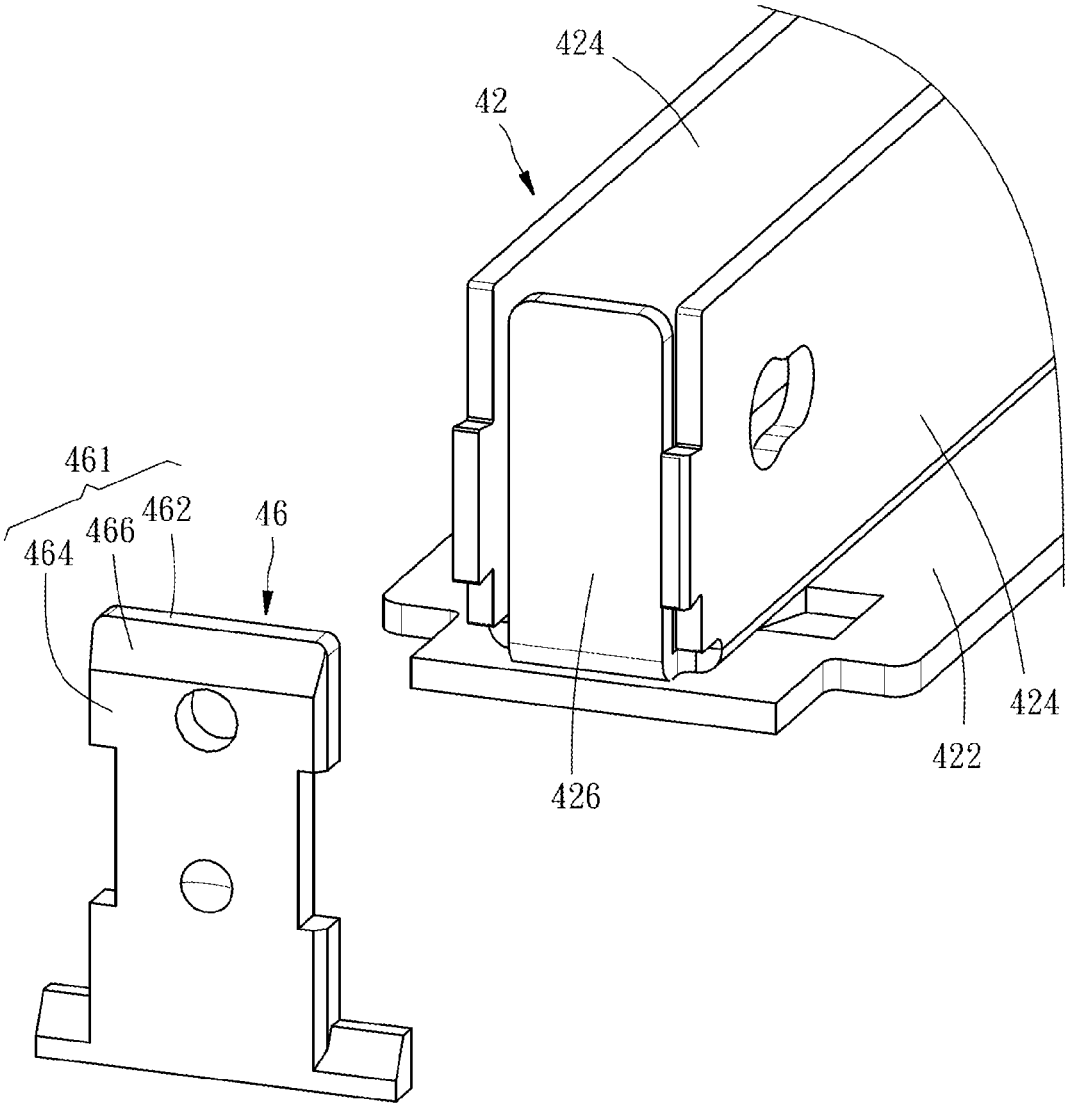
FIG. 5 is an exploded view of a staple cutting element and a body of the magazine of the staple gun automatically applicable to staples of multiple sorts according to the first preferred embodiment of the present invention.
Figure 6:
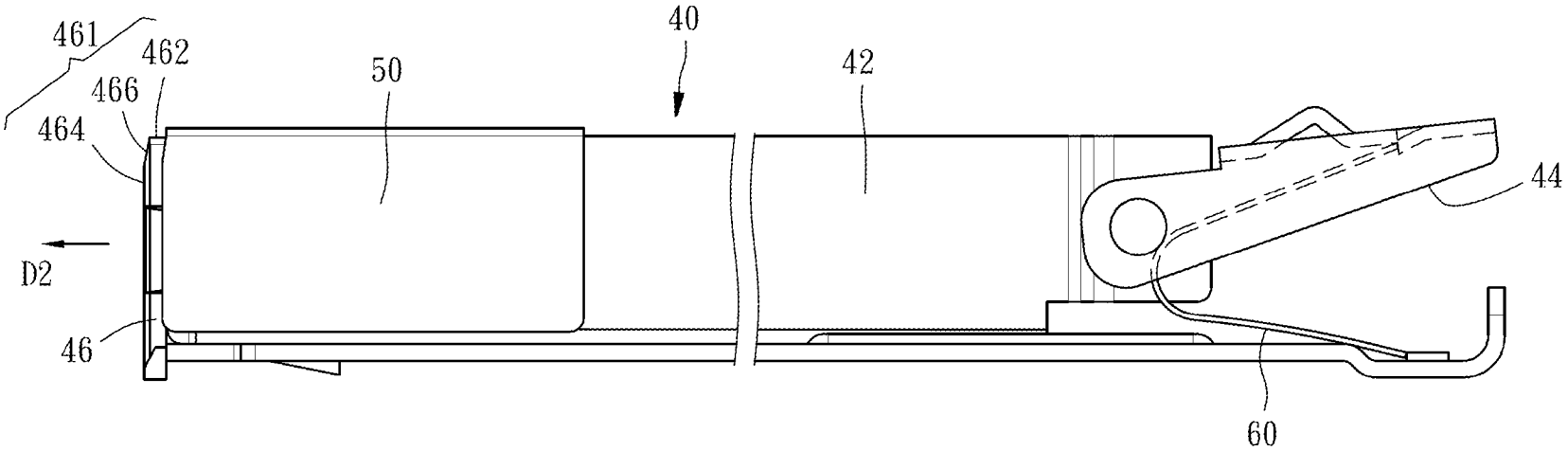
FIG. 6 is a lateral view of FIG. 4.

Referring to FIG. 1 and FIG. 2, when viewed from the outside, a staple gun 10 automatically applicable to staples of multiple sorts according to a first preferred embodiment of the present invention comprises a casing 20 and an arm 30 extending outward from the casing 20. The casing 20 has therein a magazine 40, a staple delivery element 50, and a resilient element 60 as shown in FIG. 3 through FIG. 7, and a staple striking element 70 (shown in FIG. 8) driven by the arm 30 to strike and eject staples in a staple striking direction D1. The arm 30, the staple striking element 70, and their operation are well known to persons skilled in the art and thus are not describe herein for the sake of brevity.

Referring to FIG. 1 and FIG. 2, the casing 20 comprises a left case element 21, a right case element 22, and a front case element 23. The left case element 21 and the right case element 22 are fixed to each other. The rear end of the left case element 21 and the rear end of the right case element 22 together form an opening 24. The front case element 23 is fixed to the front end of the left case element 21 and the front end of the right case element 22. The front case element 23 has a front blocking surface 232 (shown in FIG. 8) facing the left case element 21 and the right case element 22.

Referring to FIG. 3 through FIG. 6, the magazine 40 comprises a body 42, a pressing element 44, and a staple cutting element 46. The body 42 is longitudinally slender and comprises a bottom plate 422, two lateral plates 424 fixed to the bottom plate 422, and a front plate 426. The pressing element 44 is pivotally disposed at the rear ends of the two lateral plates 424. The staple cutting element 46 is plate-like and is fixed to the front plate 426. The staple cutting element 46 has a staple cutting portion 461. The staple cutting portion 461 has a top surface 462, a front end surface 464, and a guiding surface 466 connected between the top surface 462 and the front end surface 464. In this embodiment, the guiding surface 466 is a plane which slopes relative to the top surface 462 and the front end surface 464. The staple delivery element 50 straddles the two lateral plates 424 of the magazine 40. A spring (not shown) disposed between the two lateral plates 424 pushes the staple delivery element 50 in a staple delivering direction D2. The resilient element 60 is a V-shaped leaf spring with two ends abutting against the bottom plate 422 and the pressing element 44 of the magazine 42, respectively.

Figure 19:
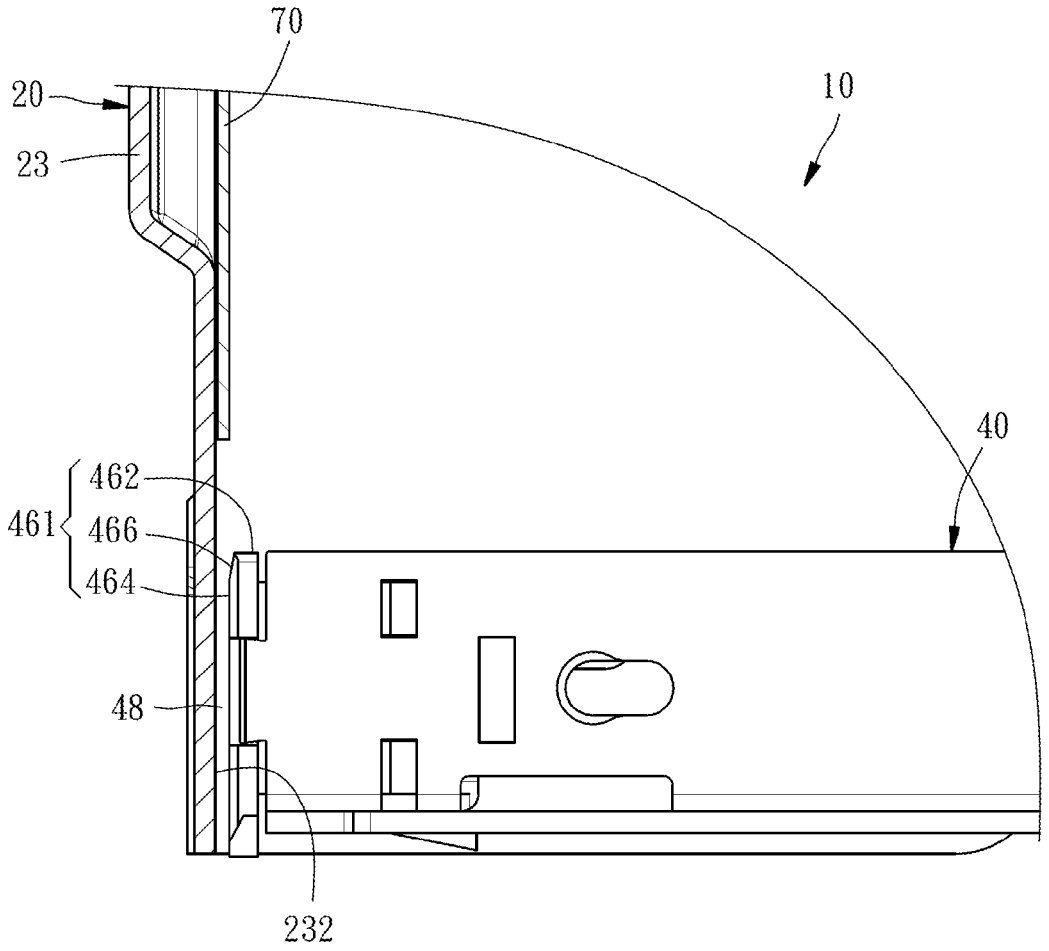
FIG. 19 is similar to FIG. 8, except that it does not show the n-shaped staples and the staple delivery element.

After being put together, the magazine 40, the staple delivery element 50, and the resilient element 60 are inserted into the casing 20 through the opening 24. Then, the user gives a press to the pressing element 44 of the magazine 40. The press must be of a strength sufficient to offset the resilience of the resilient element 60, such that the pressing element 44 approaches the bottom plate 422 and enters the casing 20. Afterward, the user stops the press on the pressing element 44 as soon as the magazine 40 enters the casing 20 entirely, so as for the pressing element 44 to come into snap-engagement with the casing 20. At this point in time, the magazine 40, the staple delivery element 50, and the resilient element 60 are confined to the casing 20, whereas not only do the front end surface 464 and the guiding surface 466 of the staple cutting portion 461 face the front blocking surface 232 of the casing 20, but a clearance 48 (shown in FIG. 8 and FIG. 19) for passing the staples is also disposed between the front end surface 464 of the staple cutting portion 461 and the front blocking surface 232 of the casing 20.

Figure 7:
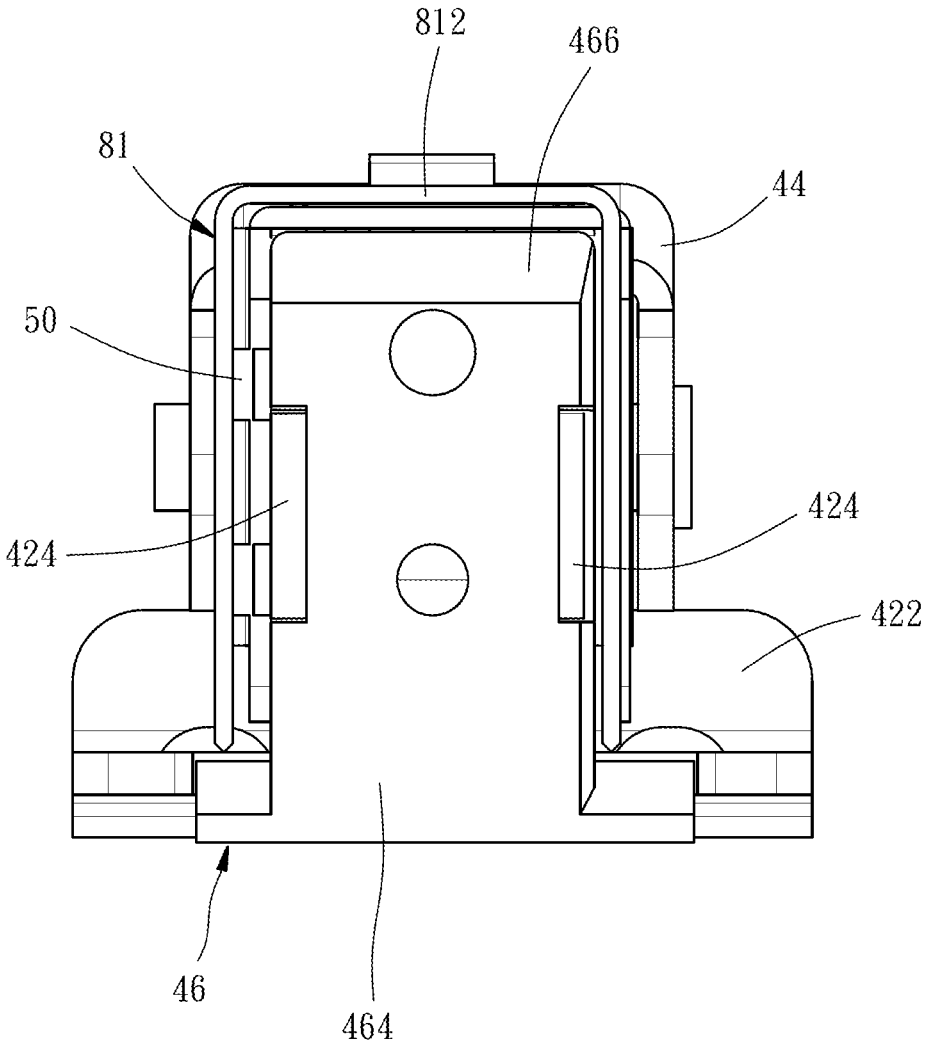
FIG. 7, which is a front view of FIG. 4, shows the magazine holding n-shaped staples.
Figure 8:
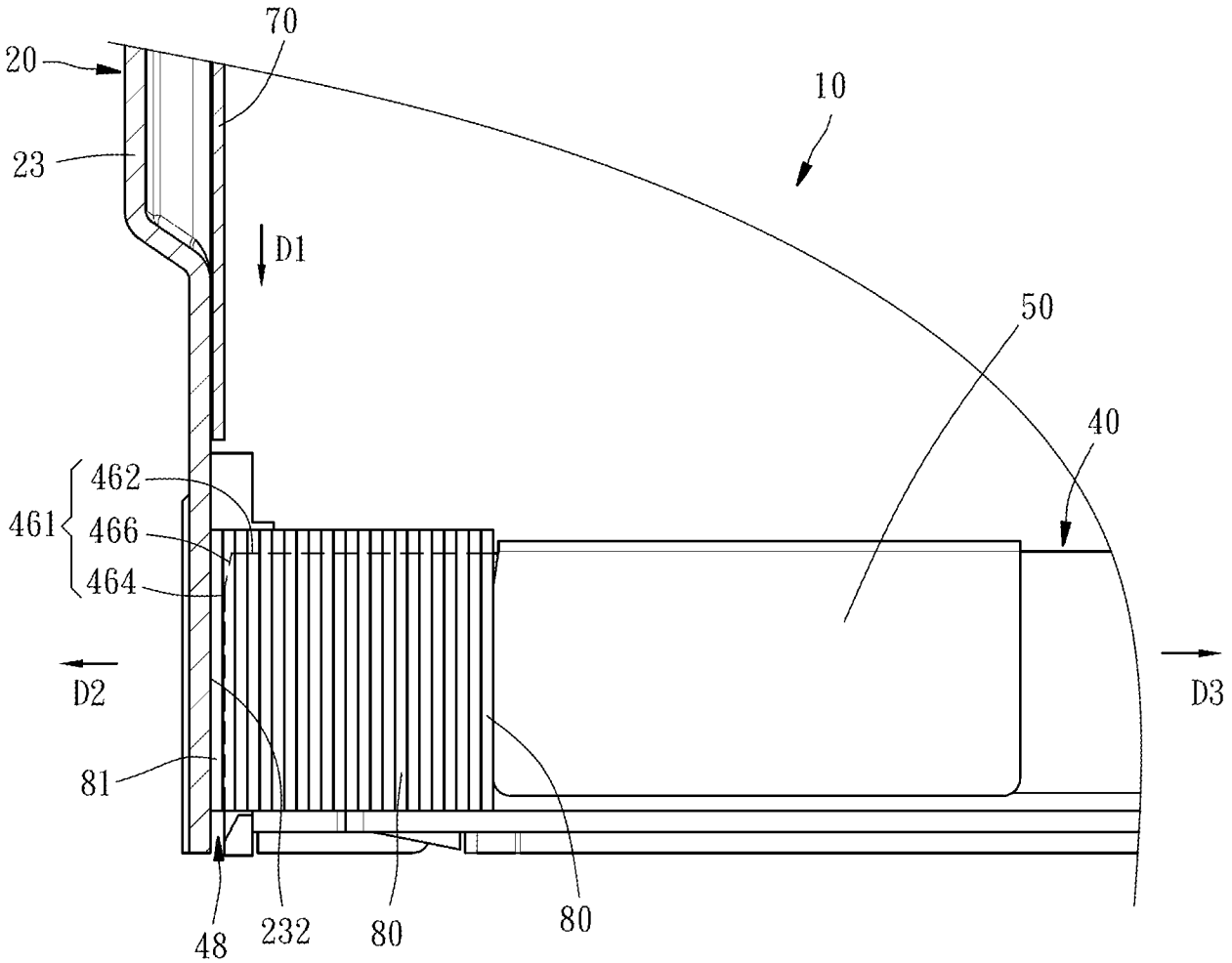
FIG. 8 is a partial cross-sectional view of the staple gun automatically applicable to staples of multiple sorts according to the first preferred embodiment of the present invention, showing that the magazine holds n-shaped staples of a small thickness.

Referring to FIG. 7 and FIG. 8, a plurality of staples 80 connected in array (and including a staple 81) straddles the two lateral plates 424 of the magazine 40. The staple delivery element 50 pushes the staples 80 in the staple delivering direction D2. Hence, the foremost staple 81 abuts against the front blocking surface 232 of the casing 20. As the thickness of the staple 81 equals the breadth of the clearance 48 exactly, a head portion 812 of the staple 81 passes through the clearance 48 as soon as the staple striking element 70 strikes the staple 81 in the staple striking direction D1, thereby ejecting the staple 81.

Figure 9:
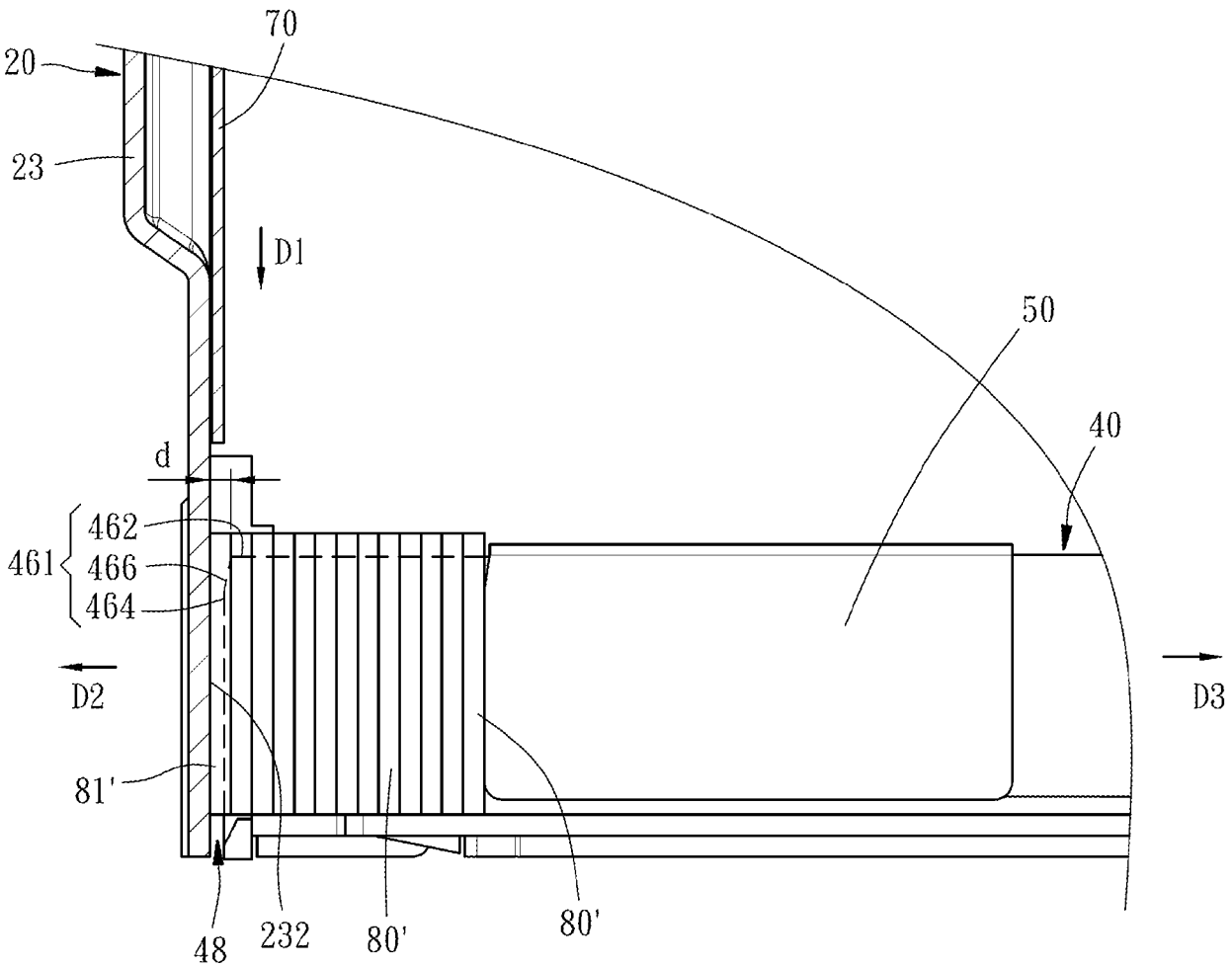
FIG. 9 is similar to FIG. 8, except that it shows the magazine holding n-shaped staples of a large thickness.

Referring to FIG. 9, in the situation where the magazine 40 is loaded with staples 80' of a large thickness, if the staple striking element 70 strikes a foremost staple 81' abutting against the front blocking surface 232, not only will the head portion of the staple 81' slide across the guiding surface 466 of the staple cutting portion 461 to reach the front end surface 464, but the magazine 40 will also advance in a clearance adjustment direction D3 opposite to the staple delivering direction D2, such that the breadth of the clearance 48 will be automatically adjusted in accordance with the thickness of the staple 81' to thereby allow the staple 81' to squeeze through the clearance 48. The clearance adjustment is characterized in that: the pressing element 44 of the magazine 40 comes into snap-engagement with the casing 20 resiliently by means of the resilient element 60; and, when the staple 81' is subjected to a strong force and conveys the strong force to the guiding surface 466 of the magazine 40, the force component exerted upon the magazine 40 in the clearance adjustment direction D3 offsets the resilience of the resilient element 60, such that the displacement of the magazine 40 in the clearance adjustment direction D3 happens but is too small to undermine the snap-engagement between the magazine 40 and the casing 20.

Figure 10:
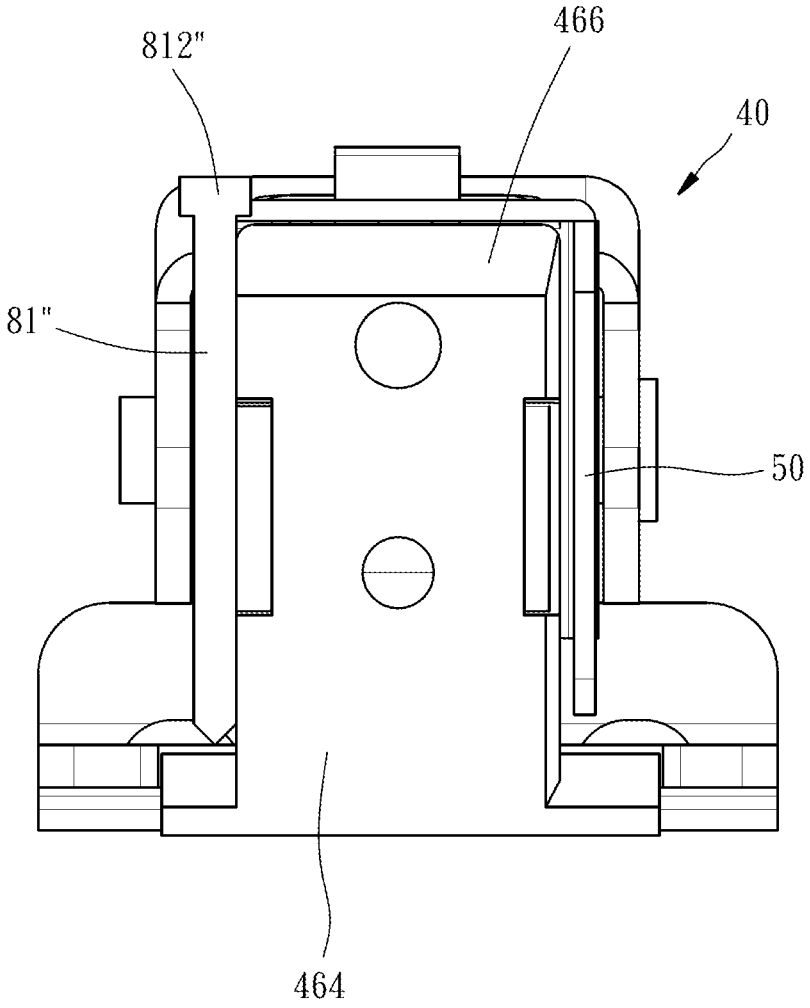
FIG. 10 is similar to FIG. 7, except that it shows the magazine holding T-shaped staples.
Figure 11:
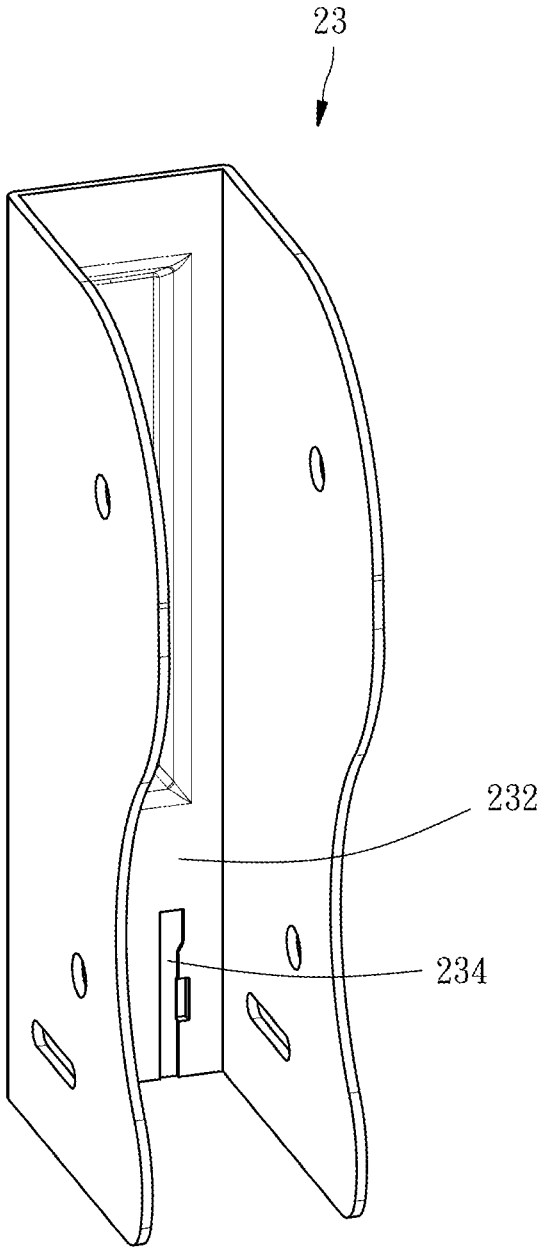
FIG. 11 is a perspective view of a front case element of the staple gun automatically applicable to staples of multiple sorts according to the first preferred embodiment of the present invention.

Although the aforesaid clearance adjustment is illustrated with n-shaped staples, it not only applies to U-shaped staples which straddle the magazine 40, but also applies to a T-shaped staple 81" shown in FIG. 10. Although the staple 81" does not straddle the magazine 40, a head portion 812" of the staple 81" abuts against the front end surface 464 and the guiding surface 466 of the magazine 40 and thus achieves clearance adjustment. Referring to FIG. 11, in this embodiment, the front case element 23 of the casing 20 has a staple-guiding groove 234 dented into the front blocking surface 232, adapted to enable the staple gun 10 to be applicable to T-shaped staples of a very large thickness, and adapted to guide the T-shaped staples being struck by the staple striking element 70 so as to keep the T-shaped staples parallel to the staple striking direction D1.

Staples frequently for use with commercially-available staple guns comprises the aforesaid T-shaped staples, U-shaped staples, and n-shaped staples each having a head portion as well as linearly-shaped staples each having staple legs but no head portion. The linearly-shaped staples usually have a relatively small thickness. In view of this, the staple gun 10 of the present invention is characterized in that: the breadth of the clearance 48 is designed to allow the linearly-shaped staples to squeeze through whenever the staple cutting portion 461 is not pushed by the staples; and, in the situation where the staple gun 10 is loaded with staples each having a head portion, the staple gun 10 will work, provided that the thickness of the staples is less than the least distance d (shown in FIG. 9) between the top surface 462 of the staple cutting portion 461 and the front blocking surface 232 of the casing 20. Hence, the staple gun 10 is automatically applicable to staples of multiple specifications and thicknesses without being tuned by a user, and thus the staple gun 10 manifests ease of use. Furthermore, the staple gun 10 has wide application, because it is not only applicable to staples of two or three thicknesses, but also applicable to staples of a specific range of thicknesses.

Figure 12:
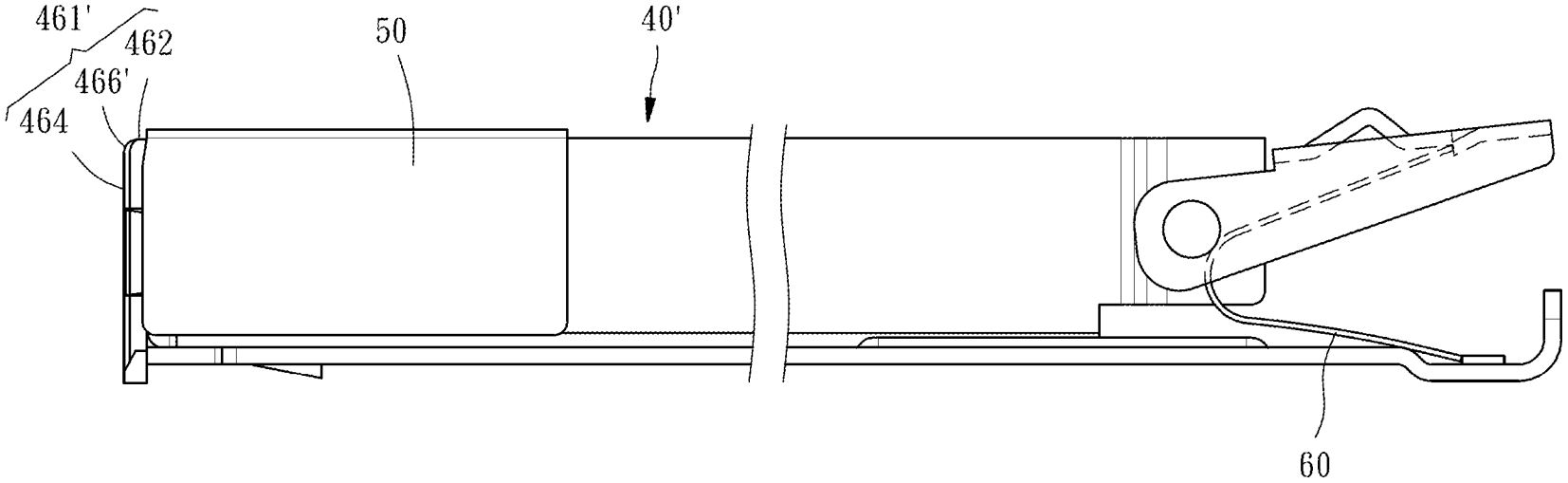
FIG. 12 is a lateral view of a magazine, a staple delivery element, and a resilient element of the staple gun automatically applicable to staples of multiple sorts according to a second preferred embodiment of the present invention.

The guiding surface 466 of the staple cutting portion 461 of the magazine 40 of the staple gun automatically applicable to staples of multiple sorts according to the present invention is not limited to a plane that slopes. The staple gun will achieve the objectives of the present invention, provided that head portions of staples are slidable across the guiding surface 466 and a strike exerted upon the staples generates a force component in the clearance adjustment direction D3. For example, referring to FIG. 12, in a second preferred embodiment of the present invention, a guiding surface 466' of a staple cutting portion 461' of a magazine 40' is a curved surface which has the aforesaid function and effect.

Figure 13:
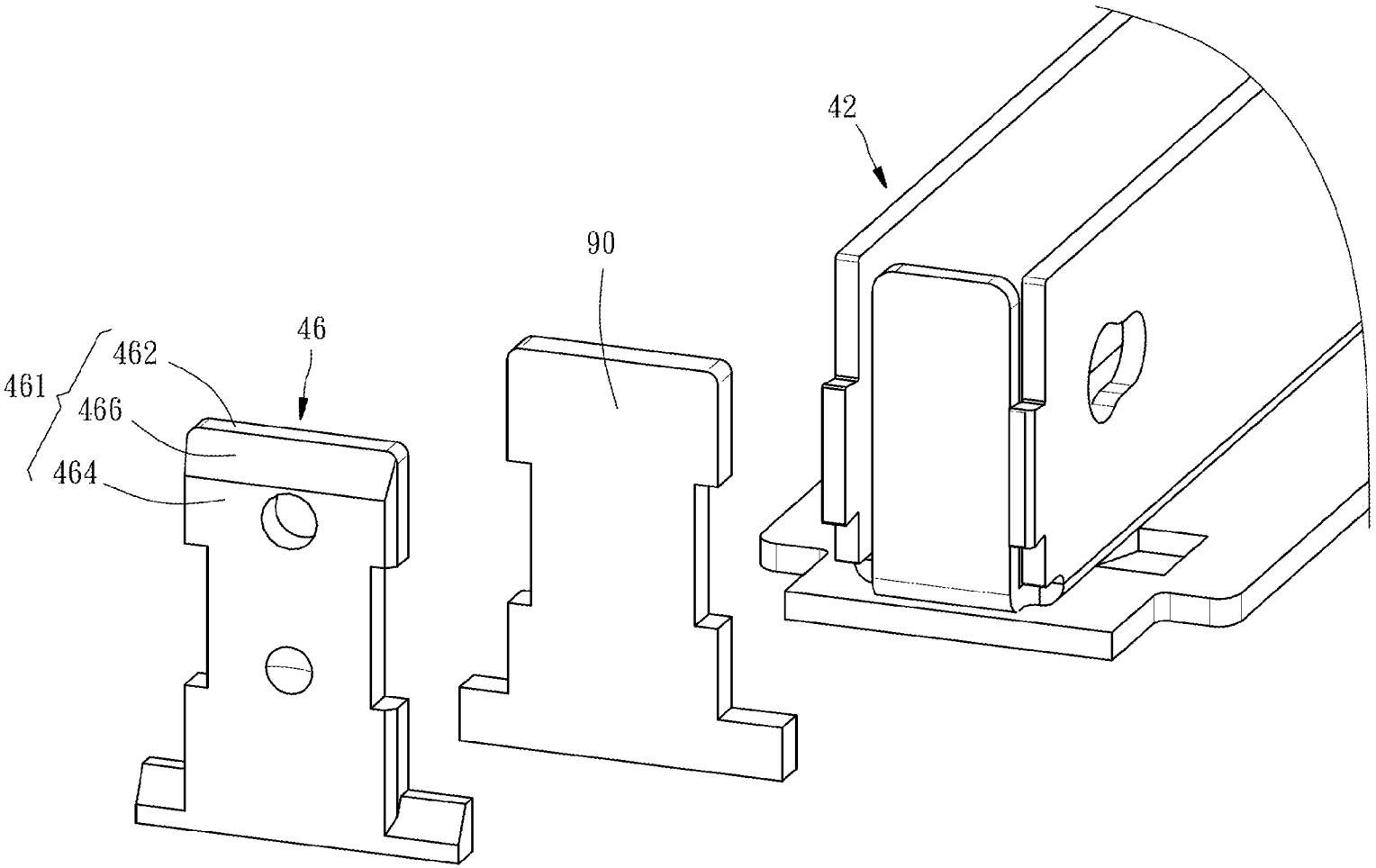
FIG. 13 is an exploded view of a magazine and a resilient element of the staple gun automatically applicable to staples of multiple sorts according to a third preferred embodiment of the present invention.

The present invention provides a staple gun automatically applicable to staples of multiple sorts, wherein the aforesaid embodiment is not restrictive of the way of positioning the magazine 40 in the casing 20, and thus the aforesaid resilient adjustment of the breadth of the clearance 48 between the magazine 40 and the casing 20 of the present invention is not necessarily achieved by means of the resilient element 60. For example, referring to FIG. 13, in a third preferred embodiment of the present invention, a resilient element 90, which is strip-like and made of a resilient material (such as rubber), is connected between the body 42 and the staple cutting element 46 of the magazine 40 to enable the staple cutting element 46 to be pushed by the staples and resiliently moved, thereby achieving automatic adjustment of the breadth of the clearance 48 in accordance with the thickness of the staples. Alternatively, the body 42 of the magazine 40 comprises a front half and a rear half, and the resilient element is disposed between the front half and the rear half to achieve the aforesaid function and effect.

Figure 20:
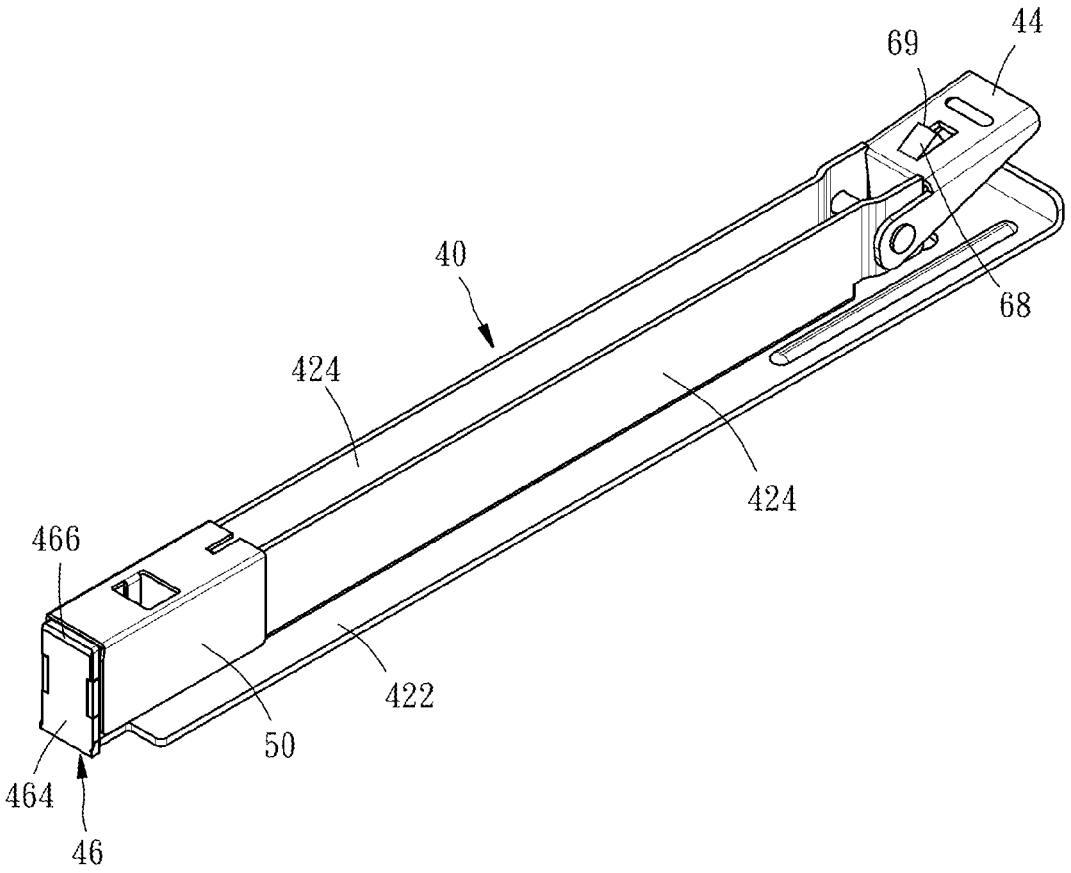
FIG. 20 is an assembled perspective view of a magazine of the staple gun automatically applicable to staples of multiple sorts according to a variant embodiment of the present invention.
Figure 21:
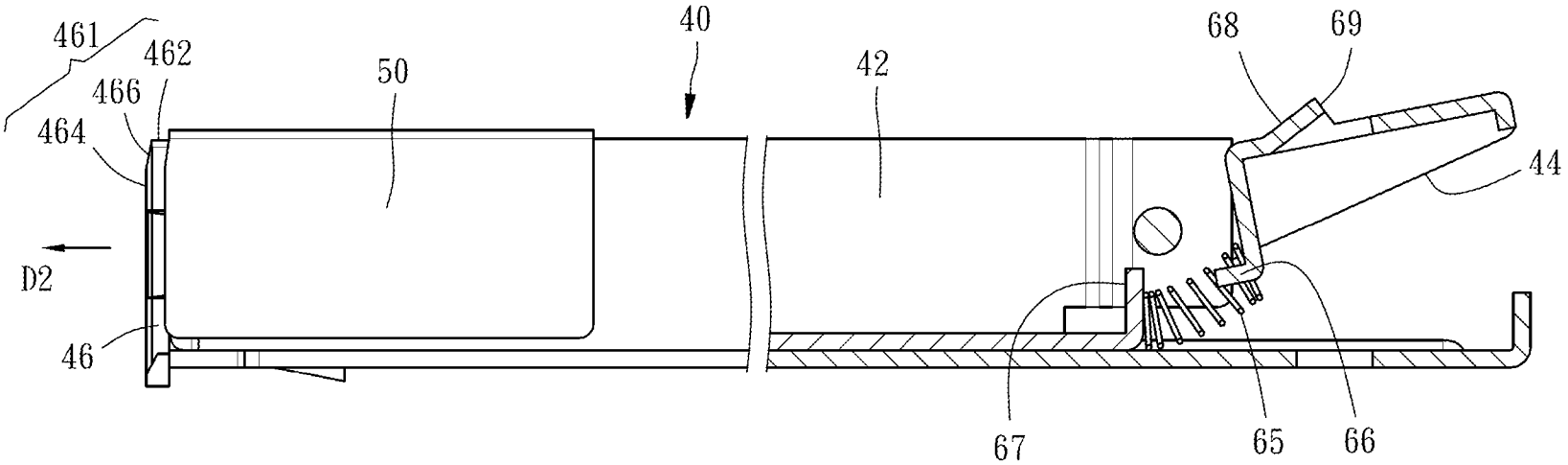
FIG. 21 is a cross-sectional view of the magazine and the resilient element of FIG. 20.

Referring to FIGS. 20, 21, a resilient element 65 of the magazine 40 can be replaced with a compression spring. The two ends of the resilient element 65 abut against a positioning portion 66 of the pressing element 44 and a fixing portion 67 of the bottom plate 422, respectively. The pressing element 44 has an engageably stopping portion 68. The engageably stopping portion 68 has an adjoining surface 69. The engageably stopping portion 68 enables the magazine 40 to be positioned in the casing 10. The adjoining surface 69 enables the engageably stopping portion 68 to come into snap-engagement with the casing 10. The resilient element 65 not only pushes the pressing element 44 but also provides the resilience required for slight reciprocating motion performed by the magazine 40 in the directions D2, D3, such that the resilient element 65 operates in conjunction with the staple cutting portion 461 to achieve the objectives of the present invention.

Figure 14:
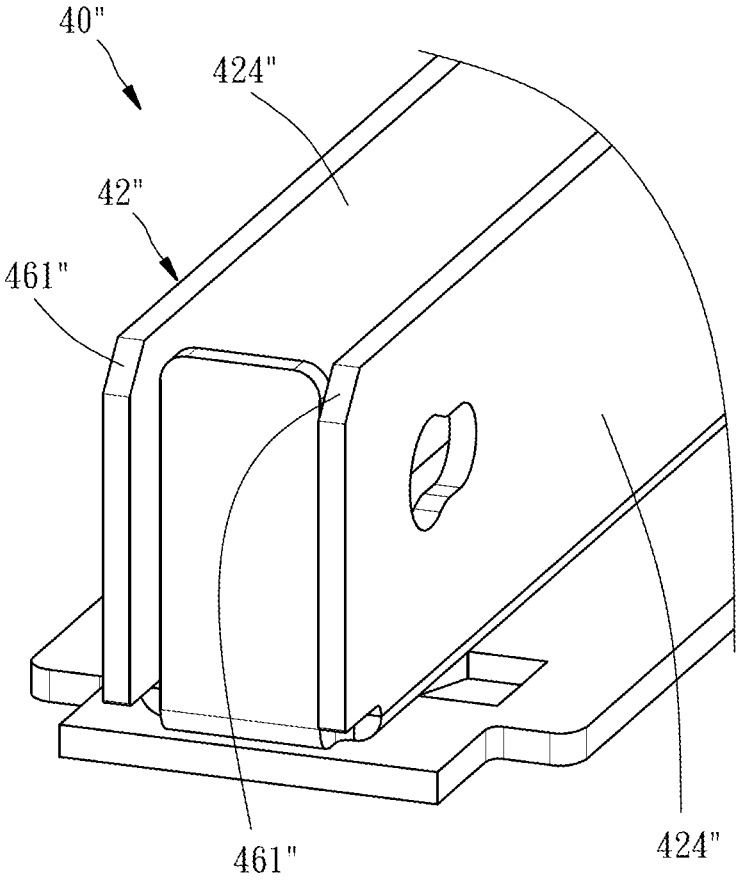
FIG. 14 is a partial perspective view of a magazine of the staple gun automatically applicable to staples of multiple sorts according to a fourth preferred embodiment of the present invention.
Figure 15:
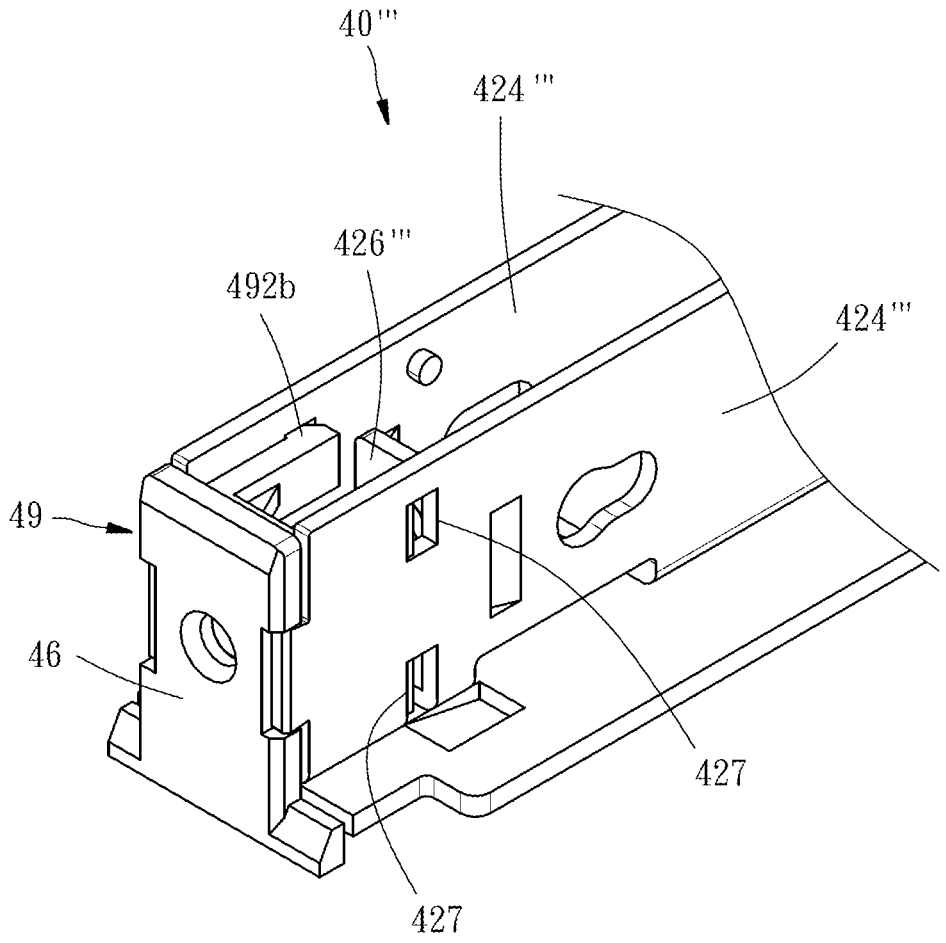
FIG. 15 is an assembled perspective view of a magazine of the staple gun automatically applicable to staples of multiple sorts according to a fifth preferred embodiment of the present invention.
Figure 16:
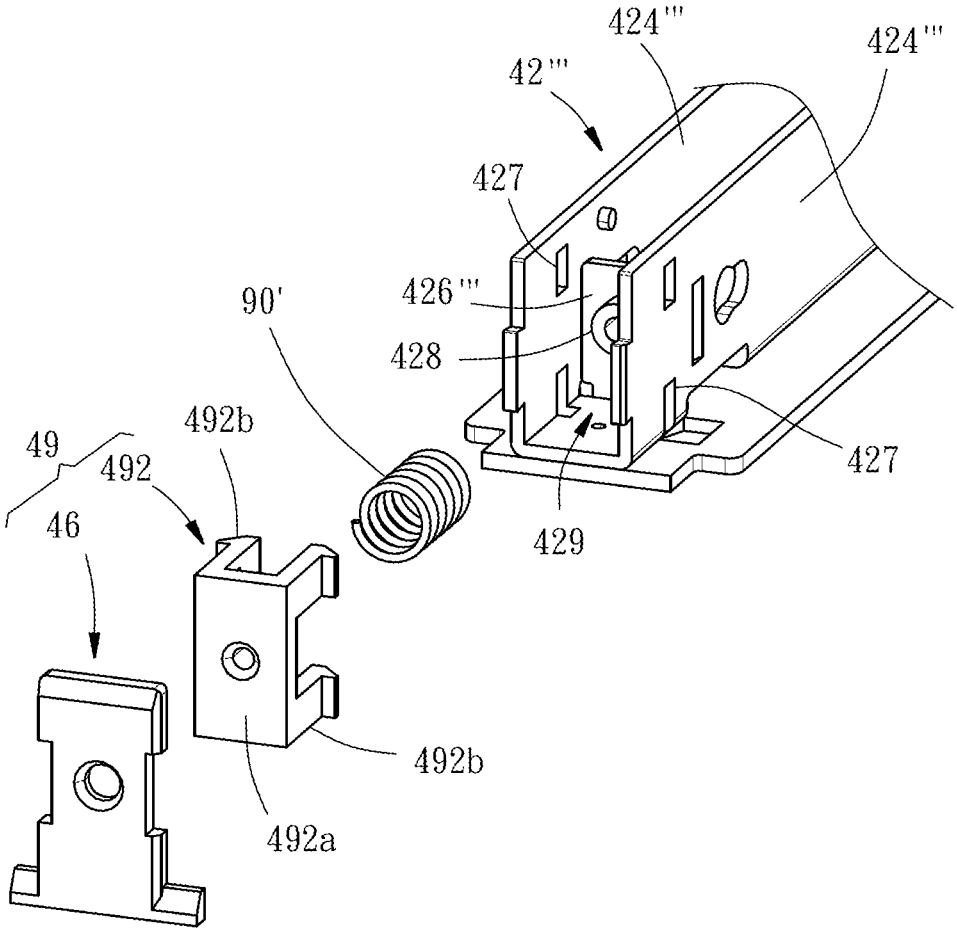
FIG. 16 is an exploded view of the magazine and a resilient element of the staple gun automatically applicable to staples of multiple sorts according to the fifth preferred embodiment of the present invention.

The present invention provides a staple gun automatically applicable to staples of multiple sorts, wherein the staple cutting portion is integrally formed at the body of the magazine. For example, referring to FIG. 14, in a fourth preferred embodiment of the present invention, a staple cutting portion 461" is integrally formed at each of the front ends of two lateral plates 424" of a body 42" of a magazine 40" to achieve the aforesaid function and effect.

Referring to FIG. 15 through FIG. 18, in a fifth preferred embodiment of the present invention, the staple gun automatically applicable to staples of multiple sorts has a magazine 40''' and a resilient element 90'. The magazine 40''' comprises a body 42''' and a displacement unit 49 movably mounted on the body 42'''. The resilient element 90' is connected between the body 42''' and the displacement unit 49 to achieve the aforesaid function of automatically adjusting clearance in accordance with staple thickness.

Specifically speaking, the body 42''' is similar to the body 42, except that two snap-engagement holes 427 are disposed at two lateral plates 424''' of the body 42''', respectively, and a front plate 426''' of the body 42''' extends forward to form a protruding post 428, wherein a receiving space 429 is defined in the front thereof. The displacement unit 49 comprises a sliding block 492 and the staple cutting element 46 having the staple cutting portion 461. The sliding block 492 comprises a plate **492*a* as well as a protruding post 492*c* and four snap-engagement portions 492*b* which are extended from the plate 492*a* in the same direction. The sliding block 492 is disposed in the receiving space 429. The snap-engagement portions 492*b* are each movably forward and backward to therefore come into snap-engagement with the snap-engagement holes 427, respectively. The staple cutting element 46 is fixed to the plate 492*a*. The resilient element 90' is a compression spring with two ends disposed around the two protruding posts 428, 492*c*, respectively, and abutting against the front plate 426''' and the plate 492*a*, respectively, to provide a resilient restoring force under which the sliding block 492 and the staple cutting element 46** are pushed in the staple delivering direction D2.

Figure 17:
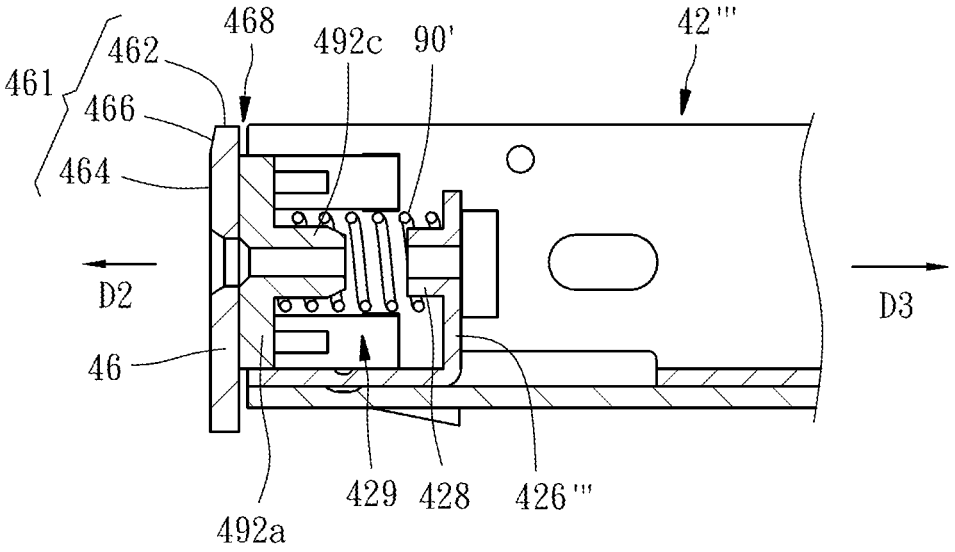
FIG. 17 and FIG. 18 are cross-sectional views of the magazine and the resilient element of the staple gun automatically applicable to staples of multiple sorts according to the fifth preferred embodiment of the present invention, illustrating their operation.
Figure 18:
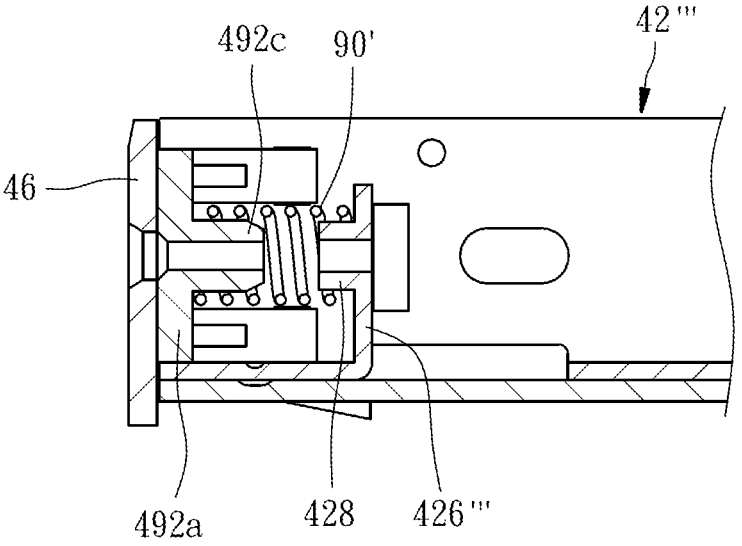

Referring to FIG. 17, before the staple cutting element 46 is pushed by the staples, the plate 492*a* of the sliding block 492 protrudes from the body 42''', such that a gap 468 is formed between the staple cutting element 46 and the body 42''', wherein the gap 468 enables the staple cutting element 46 being pushed by the staples to move in the clearance adjustment direction D3 (shown in FIG. 18). As regards the displacement unit 49 in this embodiment, the staple cutting element 46 is fixed to the sliding block 492 by means of a screw (not shown); however, it is also feasible for the staple cutting element 46 and the sliding block 492 to be integrally formed as a unitary structure.

Constituent elements disclosed in the aforesaid embodiments of the present invention are illustrative rather than restrictive of the scope of the present invention. Changes or replacements of other equivalent elements should fall within the claims of the present invention.

What is claimed is:

1. A staple gun automatically applicable to staples of multiple sorts, comprising:

a casing having a front blocking surface;

a magazine comprising at least a staple cutting portion, the staple cutting portion having a top surface, a front end surface, and a guiding surface connected between the top surface and the front end surface, the magazine being disposed in the casing and adapted to hold a plurality of staples, wherein the front end surface and the guiding surface of the staple cutting portion face the front blocking surface of the casing, and a clearance for passing the staples is disposed between the front end surface of the staple cutting portion and the front blocking surface of the casing;

a staple delivery element disposed at the magazine and adapted to push the staples in the magazine in a staple delivering direction such that one of the staples abuts against the front blocking surface of the casing; and a resilient element disposed at the magazine and adapted to enable the staples to push the front end surface and the guiding surface of the staple cutting portion of the magazine, such that the magazine moves relative to the casing in a clearance adjustment direction opposite to the staple delivering direction;

wherein the magazine comprises a body and a pressing element pivotally disposed at the body, and the resilient element is disposed between the body and the pressing element and adapted to enable the pressing element to enter the casing when subjected to a press and then come into snap-engagement with the casing as soon as the press stops.

2. The staple gun automatically applicable to staples of multiple sorts of claim 1, wherein the guiding surface of the staple cutting portion of the magazine is a plane which slopes relative to the top surface and the front end surface.

3. The staple gun automatically applicable to staples of multiple sorts of claim 1, wherein the magazine comprises a staple cutting element fixed to an end of the body, and the staple cutting portion is disposed at the staple cutting element.

4. The staple gun automatically applicable to staples of multiple sorts of claim 1, wherein the casing has a staple-guiding groove dented into the front blocking surface.

* * * * *